US008307683B2

(12) United States Patent
Jung

(10) Patent No.: US 8,307,683 B2
(45) Date of Patent: Nov. 13, 2012

(54) APPARATUS FOR MANUFACTURING COIL SPRING

(75) Inventor: Chan Gi Jung, Seoul (KR)

(73) Assignee: Daewon Kang Up Co., Ltd., Seoul (KR)

( * ) Notice: Subject to any disclaimer, the term of this patent is extended or adjusted under 35 U.S.C. 154(b) by 917 days.

(21) Appl. No.: 12/440,747

(22) PCT Filed: Dec. 7, 2006

(86) PCT No.: PCT/KR2006/005262

§ 371 (c)(1),
(2), (4) Date: Mar. 11, 2009

(87) PCT Pub. No.: WO2008/035833

PCT Pub. Date: Mar. 27, 2008

(65) Prior Publication Data

US 2010/0050725 A1 Mar. 4, 2010

(30) Foreign Application Priority Data

Sep. 21, 2006 (KR) ..... 10-2006-0091758

(51) Int. Cl.
*B21F 3/04* (2006.01)
*B21C 47/00* (2006.01)

(52) U.S. Cl. ..... 72/148; 72/142; 72/96

(58) Field of Classification Search ..... 72/84, 85, 72/95, 96, 112, 135, 142, 146, 148
See application file for complete search history.

(56) References Cited

U.S. PATENT DOCUMENTS

| | | | | |
|---|---|---|---|---|
| 2,450,324 | A * | 9/1948 | Wilson et al. | 72/142 |
| 4,576,028 | A | 3/1986 | Morita | |
| 4,713,956 | A | 12/1987 | Sasaki et al. | |
| 5,277,046 | A * | 1/1994 | Paybarah et al. | 72/142 |

FOREIGN PATENT DOCUMENTS

| | | | |
|---|---|---|---|
| JP | 63123535 | A | 5/1988 |
| JP | 4288939 | A | 10/1992 |
| JP | 11169983 | A | 6/1999 |

* cited by examiner

*Primary Examiner* — Teresa M Ekiert
(74) *Attorney, Agent, or Firm* — The Webb Law Firm

(57) ABSTRACT

An apparatus for manufacturing a coil spring. In the apparatus, a body is provided and a pair of machining units are disposed on the body to oppose each other at one end thereof. In each of the machining units, a mandrel is disposed in an upper central part of the body. The mandrel is rotatably configured to wind a coil spring material around an outer circumference thereof. A first motor is disposed at the other end of the machining unit to provide a driving force for rotating the mandrel. Also, a guide roller part is disposed movable along a length direction of the mandrel to guide the coil spring material to be wound around the mandrel. Two coil spring materials produced from a furnace are wound around the mandrels, respectively to produce two coil springs through one process.

8 Claims, 7 Drawing Sheets

Prior Art

APPARATUS FOR MANUFACTURING COIL SPRING

TECHNICAL FIELD

The present invention relates to an apparatus for manufacturing a coil spring, more particularly, in which two coil spring materials produced from a furnace are transported to two mandrels spaced apart at a short distance to be wound therearound, respectively, to produce two coil springs through one process.

BACKGROUND ART

In general, a coil spring has been manually manufactured by a skilled hand. However, for this purpose, only primitive equipment such as a shaft sealing or an apparatus for winding a heat-treated coil has been employed, thereby resulting in low productivity and non-uniform products.

Efforts have been unceasingly under way to solve problems associated with the conventional manufacturing method of the coil spring. Against this technologic backdrop, there has been a development of an apparatus for manufacturing the coil spring by winding a coil spring material produced from a furnace around a motor-rotated mandrel.

As shown in FIG. 1, the apparatus for manufacturing the coil spring has a motor 3 installed at one end of a mandrel 4. A driving shaft of the motor 3 rotates the mandrel 4 through a gear 6 inside a gear box 5.

Also, a chuck 7 is formed at the one end of the mandrel 4 to press the one end of the coil spring material 2 toward the mandrel 4 for fixing. A driving means 8 is disposed at the one end of the mandrel 4 to move the chuck 7 vertically with respect to a length direction of the mandrel 4.

The driving means 8 includes a rotating cylinder 8*a* and a rotating shaft 8*b* rotating by the rotating cylinder 8*a*. Here, the rotating shaft 8*b* is disposed rotatable about the gear box installed in a body.

That is, in the conventional apparatus for manufacturing the coil spring, the motor 3 and the gear 6 are disposed at the one end of the mandrel 4 and the rotating cylinder 8*a* and the rotating shaft 8*b* are also disposed at the one end of the mandrel 4.

The apparatus for manufacturing the coil spring as configured above has been improved partially in terms of a manufacturing method over the manual production of the coil spring. But the apparatus as just described also bears limitations due to inability to produce a great number of coil springs. That is, the apparatus for manufacturing the coil spring is configured such that only one coil spring is produced with a coil spring material 2 produced from a furnace, thereby demonstrating ineffective productivity.

SUMMARY OF THE INVENTION

The present invention has been made to solve the foregoing problems of the prior art and therefore an aspect of the present invention is to provide an apparatus for manufacturing a coil spring in which two coil spring materials produced from a furnace are transported to two mandrels spaced apart from each other at a short distance to be wound therearound, respectively to produce two coil springs through a process.

According to an aspect of the invention, the invention provides an apparatus for manufacturing a coil spring. The apparatus includes a body; a pair of machining units disposed on the body to oppose each other at one end thereof, wherein each of the machining units includes a mandrel disposed in an upper central part of the body, the mandrel rotatably configured to wind a coil spring material around an outer circumference thereof; a first motor disposed at the other end of the machining unit to provide a driving force for rotating the mandrel; and a guide roller part disposed movable along a length direction of the mandrel to guide the coil spring material to be wound around the mandrel, wherein two coil spring materials produced from a furnace are wound around the mandrels, respectively to produce two coil springs through one process.

Each of the machining units further includes a chuck configured vertically movable and disposed at one end of the mandrel to fix one end of the coil spring material to the one end of the mandrel; and a first cylinder disposed at the one end of the mandrel perpendicular to a length direction of the mandrel to provide a driving force for moving the chuck vertically with respect to the length direction of the mandrel.

Preferably, each of the guide roller parts includes a guide roller for pressing and guiding the coil spring material wound around the mandrel toward the mandrel; a second cylinder disposed at an outer circumference of the mandrel to oppose each other, thereby moving the guide roller vertically and; a transport part having a screw shaft rotating by a second motor to transport the guide roller along the length direction of the mandrel and a guide shaft for guiding the guide roller.

Moreover, preferably, the guide roller part further includes a third cylinder configured to reciprocally move the guide roller along the guide shaft to adjust a lead angle of the coil spring material while the guide roller moves along the screw shaft.

Preferably, a pair of the guide roller part is disposed at both sides of the mandrel to selectively produce a left- or right-handed coil spring.

In the apparatus for manufacturing the coil spring, the body is configured as an upper body and a lower body with respect to hinges formed respectively below the mandrels, wherein the mandrels, the first motors, and the guide roller parts are disposed in the upper body, the apparatus further including third motors disposed in the lower body to rotate the upper body around the hinges.

Also, preferably, each of the machining units further includes a tangent roller spaced apart at a predetermined distance from the outer circumference of the mandrel to separate the other end of the coil spring material from the mandrels, thereby guiding the other end of the moving coil spring material.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Exemplary embodiments of the present invention will now be described in detail with reference to the accompanying drawings.

Figure 1:
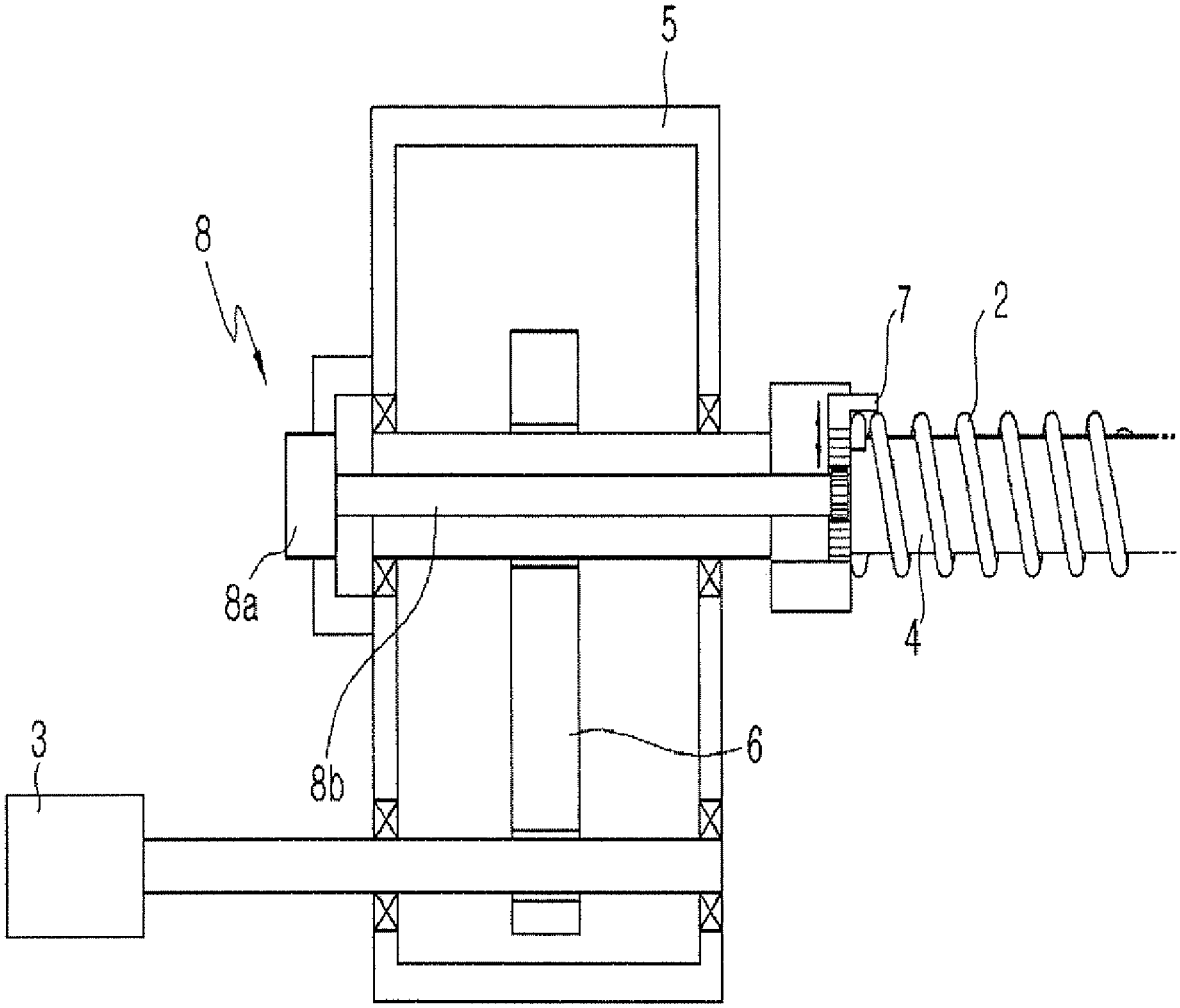
FIG. 1 is a view illustrating a conventional apparatus for manufacturing a coil spring.
Figure 2:
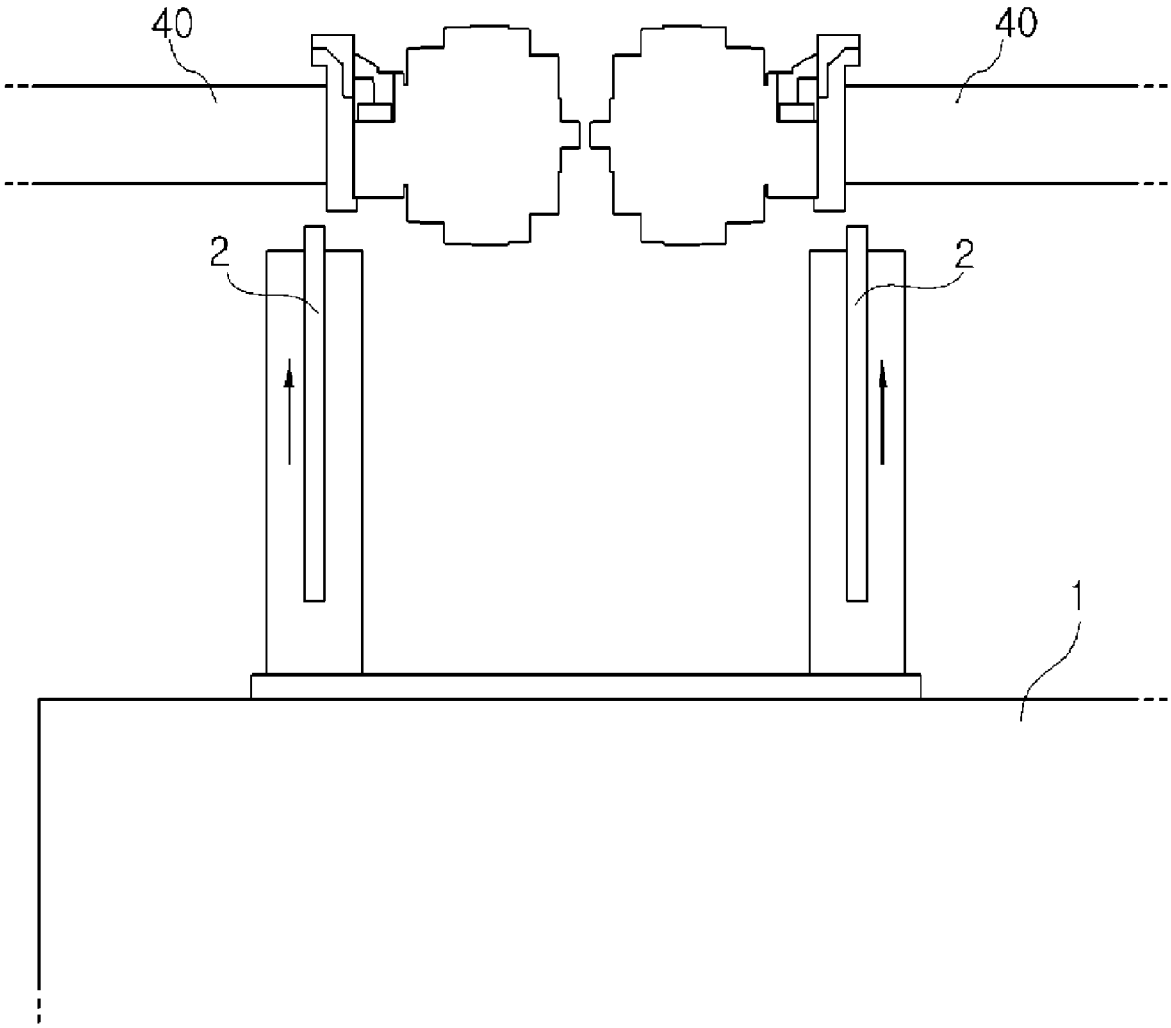
FIG. 2 is a schematic view illustrating two mandrels of an apparatus for manufacturing a coil spring to which coil spring materials produced from a furnace are transported according to a preferred embodiment of the present invention.
Figure 3:
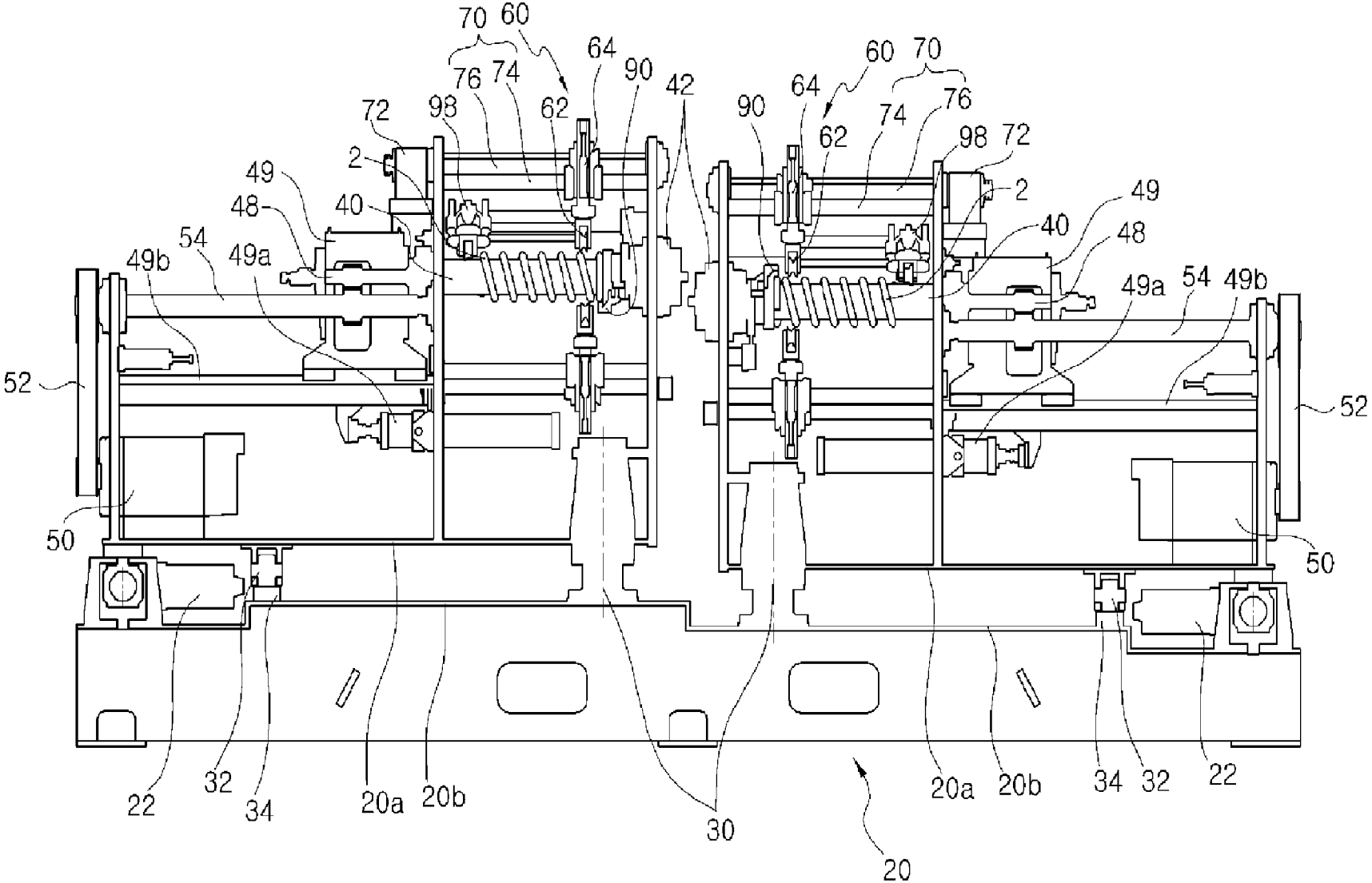
FIG. 3 is a front view illustrating an apparatus for manufacturing a coil spring according to a preferred embodiment of the invention.
Figure 4:
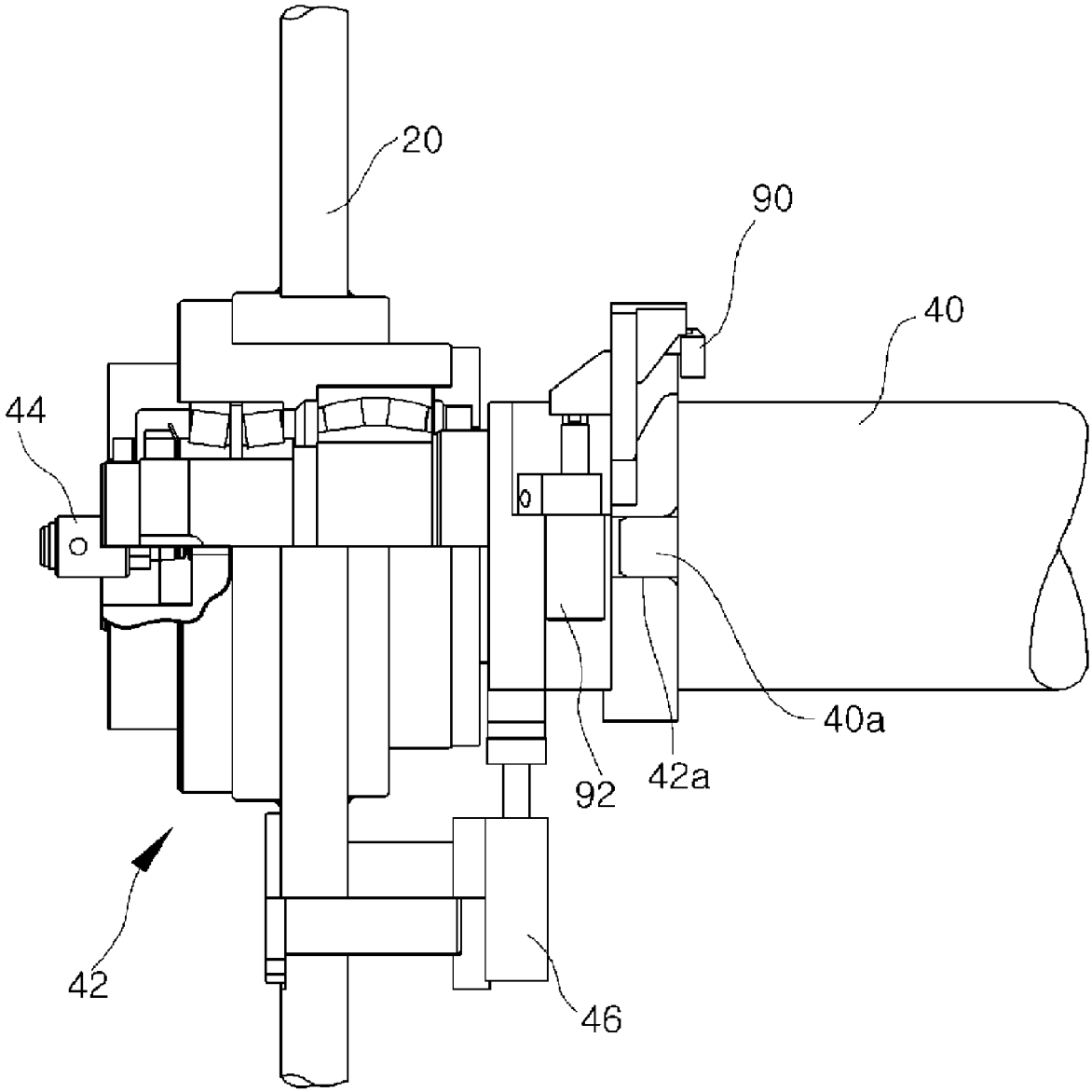
FIG. 4 is a front configuration view illustrating a front end of a mandrel in the apparatus for manufacturing the coil spring of FIG. 3.

FIG. 2 is a schematic view illustrating two mandrels of an apparatus for manufacturing a coil spring to which coil spring materials produced from a furnace are transported according to a preferred embodiment. FIG. 3 is a front view illustrating an apparatus for manufacturing a coil spring according to a preferred embodiment of the invention. FIG. 4 is a front configuration view illustrating a front end of the apparatus for manufacturing the coil spring of FIG. 3.

With reference to the drawings, the apparatus for manufacturing the coil spring of the invention can produce a coil spring from respective two mandrels 40 at one time. The apparatus includes a body 20 and a pair of machining units disposed on the body 20 to oppose each other at one end thereof. Each of the machining units includes a mandrel 40 disposed in the body 20, a first motor 50 and a guide roller part 60.

The two mandrels 40 are disposed in an upper central part of the body to oppose each other at one end thereof. That is, the mandrels 40 are disposed in an upper central part of the body 20 to be spaced apart from each other at a short distance.

The mandrels 40 are positioned such that a coil spring is produced from the respective mandrels 40 at one time. That is, according to the invention, to produce two coil springs at one time, the two mandrels 40 are installed within a close proximity so that two coil spring materials 2 produced from a furnace 1 are transported to the mandrels 40, respectively through a door of the furnace 1.

Each of the mandrels 40 has one end disposed in a mandrel fixing part 42 and the other end disposed in a mandrel gear 48. In this configuration, the mandrel 40 has the one end provided with a square fixing pillar 40*a* at one side thereof to be inserted into an angled fixing protrusion 42*a* formed in the mandrel fixing part 42, and the other end engagingly fixed to the mandrel gear 48. This prevents the mandrel 40 from idling with respect to the mandrel fixing part 42 and the mandrel gear 48.

Here, the mandrel 40 is rotatably configured to wind each of the coil spring materials 2 around an outer circumference thereof. The first motor 50 is disposed at the other end of the machining unit to provide a driving force for rotating the mandrel.

As just described, to rotate the mandrel 40 by the first motor 50, the first motor 50 is started and a ball spline shaft 54 connected to the first motor 50 and a timing belt 52 is rotated. Then the rotating ball spline shaft 54 rotates the mandrel gear 48 meshing with the ball spline shaft 54, eventually rotating the mandrel 40 having the other end engagingly attached to the mandrel gear 48.

Also, the mandrel gear 48 engagingly attached to the other end of the mandrel 40 is installed in the mandrel gear box 49. The mandrel gear box 49 is disposed movable on a linear rail 49*b* installed in the body 20 by virtue of an air cylinder 49*a*.

As just described, the mandrel gear box 49 is movably configured so that the mandrel 40 engagingly attached to the mandrel gear 48 of the mandrel gear box 49 becomes movable. Accordingly, with the coil spring completed in the mandrel 40, the mandrel 40 is moved to be spaced apart from the mandrel fixing part 42, thereby detaching the coil spring from the mandrel 40.

That is, when wound around the outer circumference of the mandrel 40 into the coil spring, the mandrel gear box 49 is moved by the air cylinder 49*a*, separating the mandrel 40 from the mandrel fixing part 42. Then, the coil spring material 2 is moved to the other end of the mandrel 40. In this fashion, the mandrel 40 is moved and the coil spring having the one end fixed to the mandrel 40 by the chuck 90 is disengaged from the mandrel 40. Then, the coil spring disengaged from the mandrel 40 drops off to be collected.

Here, to detach the mandrel 40 from the mandrel fixing part 42, the square fixing pillar 40*a* formed at the one end side portion of the mandrel 40 is disengaged from the angled fixing protrusion 42*a* of the mandrel fixing part 42.

Also, the mandrel 40 can be replaced depending on the type and diameter size of the coil spring to be manufactured.

Meanwhile, as shown in FIG. 4, each of the machining units further includes a chuck 90 and a first cylinder 92. The chuck 90 is configured vertically movable and disposed at one end of the mandrel to fix one end of the coil spring material 2 to the one end of the mandrel 40. The first cylinder 92 provides a driving force for moving the chuck 90 vertically with respect to the length direction of the mandrel.

The chuck 90 is disposed vertically movable on the mandrel fixing part 42 fixed to the one end of the mandrel 40. The chuck 90 presses the one end of the coil spring 2 against the mandrel 40 with a predetermined power or more, thereby fastening the one end of the coil spring material 2 to the mandrel 40.

The first cylinder 92 providing a driving force for vertically moving the chuck 90 is disposed in the mandrel fixing part 42 installed at the one end of the mandrel 40, perpendicular to a length direction of the mandrel 40.

In addition, the mandrel fixing part 42 fastened to the one end of the mandrel rotating by the first motor 50 is rotated along with the mandrel 40. The rotating mandrel fixing part 42 is joined to the body 20 by a rotary joint 44.

The body 20 has a stopper cylinder 46 configured to stop the mandrel fixing part 42, which is connected to the mandrel 40 to rotate, at a certain position.

That is, the stopper cylinder 46 stops the mandrel fixing part 42 at a certain position so that in a case where the mandrel 40 has the one end detached from the mandrel fixing part 42 and then re-joined to the mandrel fixing part 42, the square fixing pillar 40*a* at the one end of the mandrel 40 is inserted into the angled fixing protrusion 42*a* of the mandrel fixing part 42.

In the apparatus for manufacturing the coil spring as just configured, each of the machining units includes the mandrel 40 and the first motor 50 disposed at the other end of the machining unit to provide a rotational force to the mandrel 40 to wind the coil spring material 2. Thus, compared to the prior art, an extra space can be formed at the one end of the mandrel 40 so that the pair of the mandrels 40 are spaced apart at a short distance from a central portion of the body 20 to oppose each other at one end thereof.

Furthermore, the first cylinder 92 is disposed perpendicular to a length direction of the mandrel 40 to provide a driving force for vertically moving the chuck 90 which fixes the one end of the coil spring material 2 to the one end of the mandrel 40. This further narrows a distance between the one end of one of the mandrels 40 and the one end of the other mandrel 40.

As a result, according to the invention, two coil spring materials 2 produced from a furnace 1 are transported to the two mandrels 40, respectively which are spaced apart from each other at a short distance and wound therearound, respectively, thereby producing two coil springs.

Figure 5:
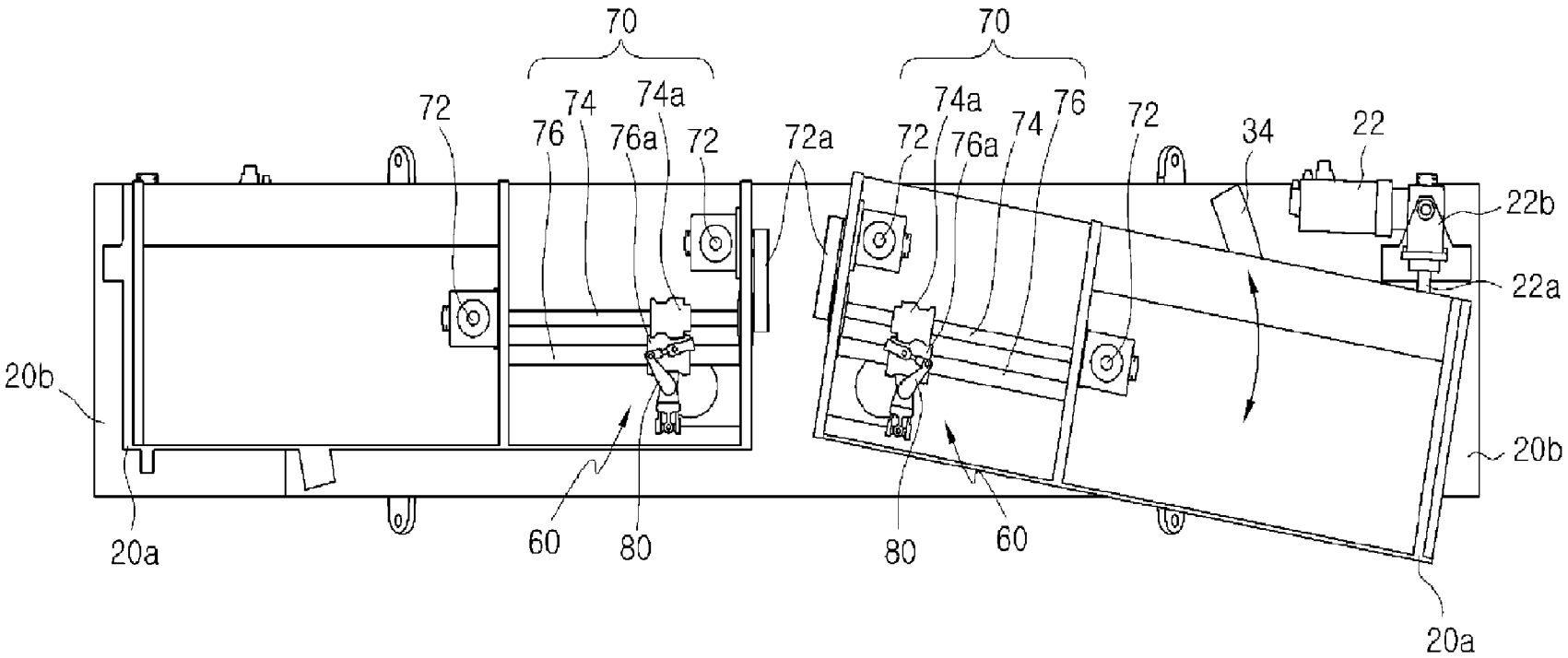
FIG. 5 is a plan view illustrating the apparatus for manufacturing the coil spring of FIG. 3.
Figure 6:
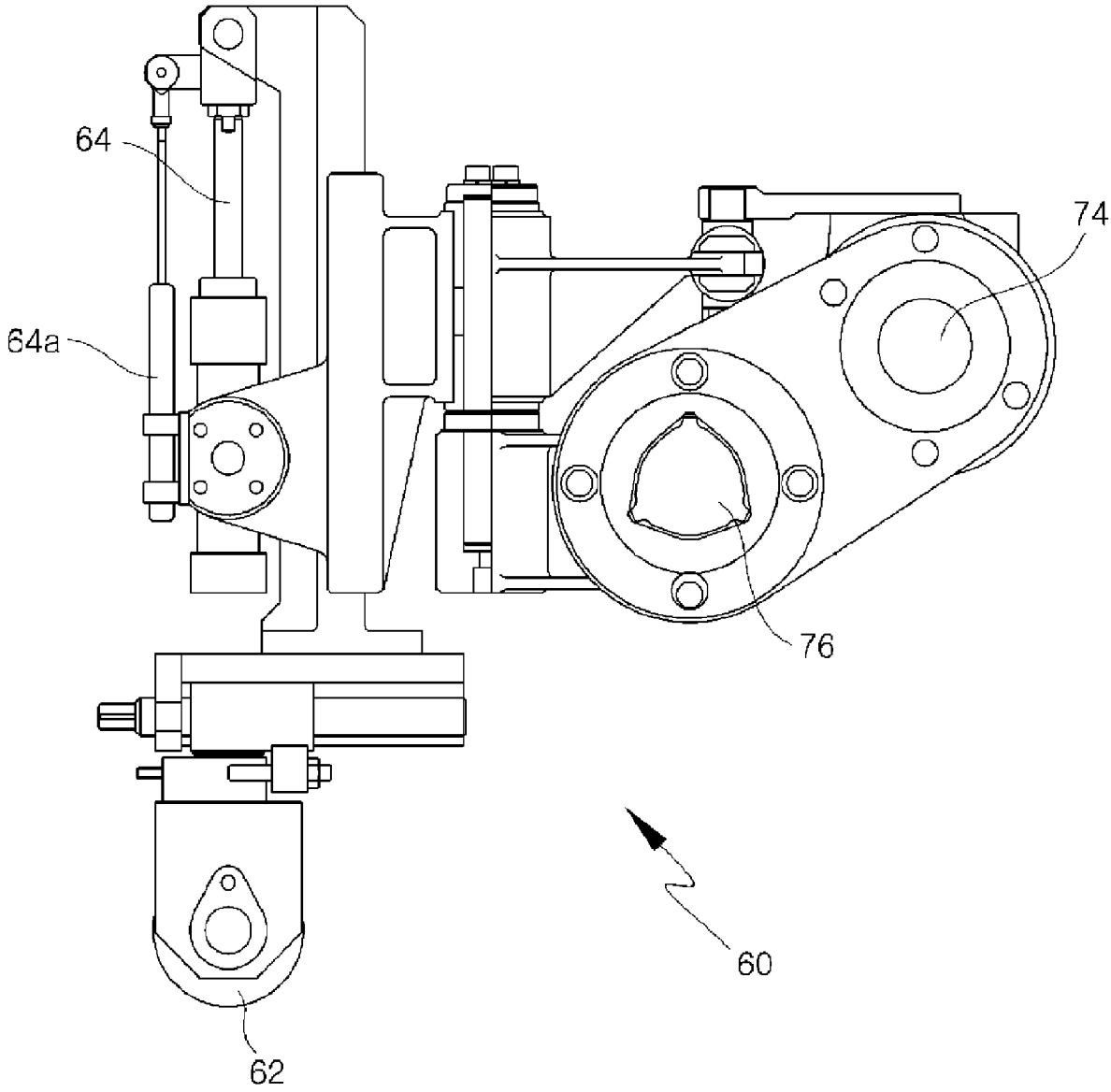
FIG. 6 is a side view illustrating a guide roller part of the apparatus for manufacturing the coil spring of FIG. 5.
Figure 7:
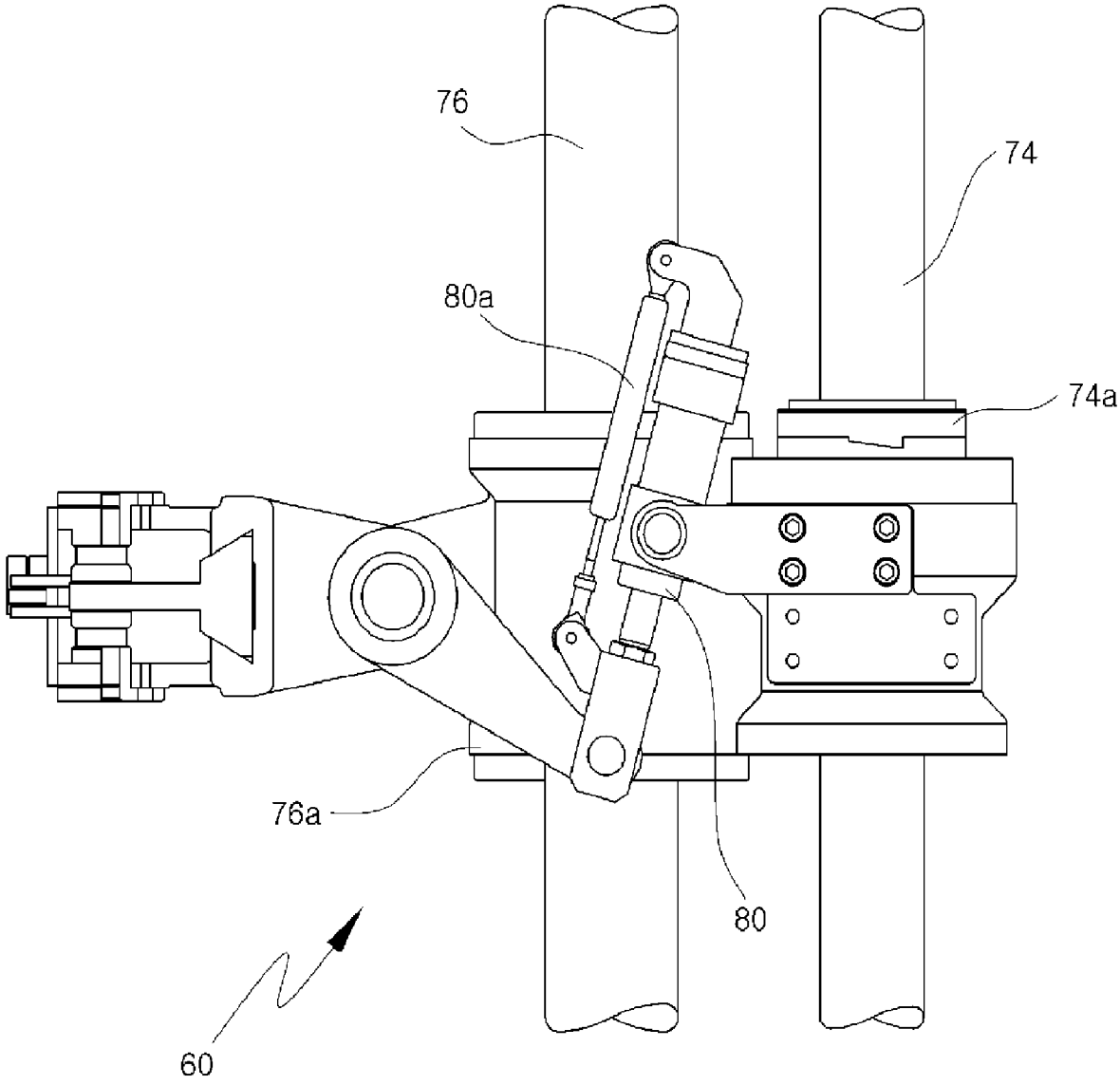
FIG. 7 is a plan view illustrating the guide roller part of FIG. 6.

FIG. 5 is a plan view illustrating an apparatus for manufacturing a coil spring of FIG. 2. FIG. 6 is a side view illustrating guide roller parts in the apparatus for manufacturing the coil spring of FIG. 5. FIG. 7 is a plan view illustrating the guide roller parts of FIG. 6.

Referring to the drawings, the guide roller parts 60 each are disposed movable along a length direction of the mandrel 40 to guide the coil spring material to be wound around the mandrel 40. Each of the guide roller parts 60 includes a guide roller 62, a second cylinder 64 and a transport part 70.

As shown in FIGS. 3 and 5, the guide roller 62 presses and guides the coil spring material wound around the mandrel 40 toward the mandrel 40. The second cylinder 64 is disposed on an outer circumference of the mandrel 40 to oppose each other, thereby moving the guide roller 62 vertically.

That is, the guide roller 62 moves vertically by the second cylinder 64 and is kept at a proper distance from the outer circumference of the mandrel 40 so that the coil spring material 2 is located between the mandrel 40 and the guide roller 62 in accordance with the outer circumference of the mandrel 40.

Preferably, the second cylinder 64 is configured with a controller (not illustrated) having Linear Variable Differential Transformer (LVDT) (64*a* of FIG. 6) which enables the guide roller 62 to be properly positioned to suit the outer circumference of the mandrel 40.

The transport part 70 includes a screw shaft 74 and a guide shaft 76. The screw shaft 74 rotates by a second motor 72 to transport the guide roller 62 along the length direction of the mandrel 40. The guide shaft 76 guides the guide roller 62. Referring to FIG. 5, the second motor 72 shown in the one end of the mandrel 40 is connected to a timing belt 72*a* to rotate the screw shaft 74 of the guide roller 60 disposed in a lower part of the mandrel 40.

On the screw shaft, a screw housing 74*a* is configured movable along with rotation of the screw shaft 74. On the guide shaft 76, a guide housing 76*a* is disposed movable along the guide shaft 76. Preferably, the screw housing 74*a* and the guide housing 76*a* each have a ball in an inner circumference thereof to move the screw shaft 74 and the guide shaft 76 smoothly. Also, preferably, the guide shaft 76 is constructed of a spline shaft to ensure both ends thereof to be fastened to the body 20.

Moreover, the guide roller part 60 further includes a third cylinder 80 configured to reciprocally move the guide roller 62 along the guide shaft 76 to vary a lead angle of the coil spring material while the guide roller moves along the screw shaft 74.

The third cylinder 80 is fixed to the screw housing 74*a* to reciprocally move the guide roller 62 disposed in the guide housing 76*a* along the guide shaft 76 with respect to the screw housing 74*a*. That is, to manufacture the coil spring with irregular pitches due to a variable lead angle, the third cylinder 80 is configured such that the guide roller 62 moves back and forth with respect to a moving direction while the guide roller 62 moves along the screw shaft 74.

Preferably, the third cylinder 80 is configured with a controller (not illustrated) having the LVDT (80*a* of FIG. 7) to control the variable lead angle.

Moreover, as shown in FIG. 3, the apparatus for manufacturing the coil spring, a pair of the guide roller 60 is disposed at both sides of the mandrel 40 to selectively produce a left- or right-handed coil spring. Here, the guide roller parts 60 can be installed above the mandrels 40 as shown or below the mandrels 40.

That is, in the apparatus for manufacturing the coil spring, the two mandrels 40 are disposed co-planar in a central portion of the body 20 to oppose each other at one end thereof. Also, each of the mandrel 40 is constructed of the guide roller part 60 to selectively produce the left- or right-handed coil spring.

Meanwhile, as shown in FIGS. 3 and 5, the body 20 is configured as an upper body 20*a* and a lower body 20*b* with respect to hinges 30 formed respectively below the one end of the mandrel 40.

Here, the mandrels 40, the first motors, and the guide rollers 60 are disposed in the upper body 20*a*. Third motors 22 are disposed in the lower body 20*b* to rotate the upper body 20*a* about the hinges 30.

With rotation of the screw shaft 22*a*, which drives the third motors 22, the upper body 20*a* joined to the screw shaft 22*a* also moves. Preferably, each of the third motors 22 is configured with a decelerator 22*b* which decelerates at an adequate ratio to achieve a high torque.

Here, a moving roller 32 is disposed on an underside surface of the body 20*a* and a curve rail 34 is formed on an upper surface of the lower body 20*b*. Accordingly, when the moving roller 32 moves along the curve rail 34 by the third motor 22, the upper body 20*a* rotates about the hinges 30.

Conventionally, the coil spring material 2 was wound with the one end thereof fixed by gradually increasing a lead angle thereof. That is, there was no initial lead angle. However, the body 20 configured as just described is rotatable about the hinges 30, thereby producing the coil spring with the initial lead angle.

That is, the mandrel 40 rotates when the upper body 20*a* rotates at a certain angle as described above. This enables the coil spring material 2 to have the initial lead angle formed at the one end thereof.

As shown in FIG. 3, in the apparatus for manufacturing the coil spring, each of the machining units further includes a tangent roller 98 spaced apart at a predetermined distance from the outer circumference of the mandrel 40 to separate the other end of the coil spring material form the mandrel 40.

The tangent roller 98 is placed at a predetermined distance from the outer circumference of the mandrel 40 to guide the moving coil spring material, thereby separating the other end of the coil spring from the mandrel 40 at a predetermined distance.

That is because the coil spring produced from the coil spring material 2 has the other end fixed to a body (not illustrated) of a car. That is, in a case where the other end of the coil spring is round, the coil spring idles with respect to the body of the car. To prevent this, the other end of the coil spring is spaced apart from the mandrel at a predetermined distance 40. Accordingly, the edge portion of the other end of the coil spring is hooked onto a hook (not illustrated) formed in the car.

Now, a detailed explanation will be given about a method for manufacturing a coil spring with an apparatus for manufacturing a coil spring according to a preferred embodiment of the invention.

First, each of two coil spring materials 2 produced from a furnace 1 is transported to one end of each of two mandrels 40 which are disposed coplanar and opposing each other at one end thereof.

Then, the one end of the coil spring material 2 is pressed toward and fixed to the mandrel 40 by a chuck 90 disposed at the one end of the mandrel 40.

That is, the chuck 90 disposed in a mandrel fixing part 42 presses the one end of the coil spring material 2 toward the mandrel 40 by virtue of a first cylinder 92 disposed at the one end of the mandrel perpendicular to a length direction of the mandrel. This allows the one end of the coil spring material 2 to be fixed.

Next, a first motor 50 disposed at the other end of the mandrel 40 in the body 20 is started to rotate the mandrel 40. With the mandrel 40 rotating, the coil spring material 2 having one end fixed to the mandrel 40 by a chuck 90 is wound around an outer circumference thereof.

Here, the guide roller 62 presses the coil spring material 2 wound around the mandrel 40 toward the mandrel 40 and guides the coil spring material 2 toward the other end of the mandrel 40. This allows the coil spring material 2 to be produced as a coil spring with a certain lead angle.

That is, a second motor 72 installed in the body 20 is set to motion to rotate the screw shaft 74, thereby moving a guide roller 62 fixed to a screw housing 74*a* fastened to the screw shaft 74 in a length direction of the mandrel 40. This enables the coil spring material 2 to be produced as the coil spring with a predetermined lead angle.

The guide roller 62 is moved vertically to guide the coil spring material 2 while pressing it against an outer circumference of the mandrel 40. Here, such a vertical movement of the guide roller 62 is driven by the second cylinder 64.

To vary a lead angle of the coil spring material 2 while the guide roller 62 moves along the screw shaft 74, the guide roller 62 moves reciprocally along the guide shaft 76 with respect to the screw housing 74*a* by the third cylinder 80.

Furthermore, to form an initial lead angle at the one end of the coil spring material 2, the third motor 22 disposed in a lower body 20*b* is set to motion to rotate an upper body 20*a* with respect to hinges 30. Then, when the mandrel 40 rotates with the upper body 20*a* rotating at a predetermined angle, the coil spring material has the initial angle formed at the one end thereof.

Finally, to prevent the coil spring, when installed in a car body, from idling, the other end of the coil spring material 2 is spaced apart from the mandrel 40 at a predetermined distance so that an edge portion of the other end of the coil spring is hooked onto a hook formed inside the car body.

That is, the coil spring material 2 is guided to move toward a tangent roller 98 spaced apart from the outer circumference of the mandrel 40 at a predetermined distance so that the other end of the coil spring material 2 is spaced apart from the mandrel 40 at a predetermined distance.

In the apparatus for manufacturing the coil spring as just described, one of two guide roller parts 60 disposed at both sides of the mandrel 40 is selectively set to motion to produce a left- or right-handed coil spring, respectively from the two mandrels 40 at one time.

As set forth above, according to exemplary embodiments of the invention, an apparatus for manufacturing a coil spring has a pair of machining units disposed on a body. Each of the machining units has a first motor disposed at the other end of the machining unit to provide a driving force for rotating the mandrel in order to wind a coil spring material. Thus, compared with the prior art, an extra space is formed at one end of the mandrel so that the two mandrels are spaced apart at a short distance from a central portion of the body to oppose each other.

Also, a first cylinder is disposed perpendicular to a length direction of the mandrel to provide a driving force for vertically moving the chuck which fixes one end of the coil spring material to the one end of the mandrel. This further narrows a distance between the one end of one of the mandrels and the one end of the other mandrel.

Consequently, according to the invention, two coil spring materials produced from a furnace are transported to the two mandrels spaced apart from each other at a short distance and wound therearound, respectively to produce two coil springs through a process.

One coil spring can be produced from the respective two mandrels at one time. That is, according to the prior art, one coil spring is produced at one time while according to the invention, two coil springs are produced at one time. Thus, given productivity of the coil spring manufactured from a furnace, the yield of the coil spring can be increased on the basis of a predetermined manufacturing period.

Moreover, a guide roller part further includes a third cylinder configured to reciprocally move the guide roller along the guide shaft. Accordingly, the coil spring material can be varied in its lead angle while the guide roller moves along the screw shaft.

Also, according to the invention, a pair of the guide roller part is disposed at both sides of the mandrel to selectively produce a left- or right-handed coil spring.

Meanwhile, the body is configured as an upper body and a lower body with respect to hinges formed respectively below the mandrels. The mandrels, a first motor and the guide roller parts are disposed in the upper body. Also, third motors are disposed in the lower body to rotate the upper body about the hinges.

That is, when the mandrels rotate with the upper body rotating at a predetermined angle as just described, the coil spring material has an initial lead angle formed at one end thereof.

In addition, according to the invention, each of the machining units further includes a tangent roller spaced apart at a predetermined distance from the outer circumference of the mandrel to guide the other end of the moving coil spring material, thereby separating the other end of the coil spring material from the mandrels.

While the present invention has been shown and described in connection with the preferred embodiments, it will be apparent to those skilled in the art that modifications and variations can be made without departing from the spirit and scope of the invention as defined by the appended claims.

The invention claimed is:

1. An apparatus for manufacturing a coil spring comprising:

a body;

a pair of machining units disposed on the body to oppose each other at one end thereof, wherein each of the machining units comprises;

a mandrel disposed in an upper central part of the body, the mandrel rotatably configured to wind a coil spring material around an outer circumference thereof;

a mandrel motor disposed at the other end of the machining unit to provide a driving force for rotating the mandrel; and a guide roller part disposed movable along a length direction of the mandrel to guide the coil spring material to be wound around the mandrel, wherein two coil spring materials produced from a furnace are wound around the mandrels, respectively to produce two coil springs through one process, wherein each of the machining units further comprises:

a chuck configured vertically movable and disposed at one end of the mandrel to fix one end of the coil spring material to the one end of the mandrel; and a first cylinder disposed at the one end of the mandrel perpendicular to a length direction of the mandrel to provide a driving force for moving the chuck vertically with respect to the length direction of the mandrel.

2. The apparatus according to claim 1, wherein each of the guide roller parts comprises:

a guide roller for pressing and guiding the coil spring material wound around the mandrel toward the mandrel;

a second cylinder disposed at an outer circumference of the mandrel to oppose each other, thereby moving the guide roller vertically; and a transport part having a screw shaft rotating by a screw shaft motor to transport the guide roller along the length direction of the mandrel and a guide shaft for guiding the guide roller.

3. The apparatus according to claim 2, wherein the guide roller parts further comprises a third cylinder configured to reciprocally move the guide roller along the guide shaft to vary a lead angle of the coil spring material while the guide roller moves along the screw shaft.

4. The apparatus according to claim 3, wherein a pair of the guide roller part is disposed at both sides of the mandrel to selectively produce a left- or right-handed coil spring.

5. The apparatus according to claim 2, wherein each of the machining units further comprises a tangent roller spaced apart at a predetermined distance from the outer circumference of the mandrel to separate the other end of the coil spring material from the mandrels, thereby guiding the other end of the moving coil spring material.

6. The apparatus according to claim 1, wherein each of the machining units further comprises a tangent roller spaced apart at a predetermined distance from the outer circumference of the mandrel to separate the other end of the coil spring material from the mandrels, thereby guiding the other end of the moving coil spring material.

7. An apparatus for manufacturing a coil spring comprising:

a body;

a pair of machining units disposed on the body to oppose each other at one end thereof wherein each of the machining units comprises;

a mandrel disposed in an upper central part of the body, the mandrel rotatably configured to wind a coil spring material around an outer circumference thereof;

a mandrel motor disposed at the other end of the machining unit to provide a driving force for rotating the mandrel; and a guide roller part disposed movable along a length direction of the mandrel to guide the coil spring material to be wound around the mandrel, wherein two coil spring materials produced from a furnace are wound around the mandrels, respectively to produce two coil springs through one process, wherein the body is configured as an upper body and a lower body with respect to hinges formed respectively below the mandrels, wherein the mandrels, the mandrel motors, and the guide roller parts are disposed in the upper body, the apparatus further comprising upper body rotation motors disposed in the lower body to rotate the upper body about the hinges.

8. The apparatus according to claim 7, wherein each of the machining units further comprises a tangent roller spaced apart at a predetermined distance from the outer circumference of the mandrel to separate the other end of the coil spring material from the mandrels, thereby guiding the other end of the moving coil spring material.

* * * * *

UNITED STATES PATENT AND TRADEMARK OFFICE

CERTIFICATE OF CORRECTION

PATENT NO. : 8,307,683 B2
APPLICATION NO. : 12/440747
DATED : November 13, 2012
INVENTOR(S) : Chan Gi Jung It is certified that error appears in the above-identified patent and that said Letters Patent is hereby corrected as shown below:

Column 10, Line 5, Claim 7, after "thereof" insert -- , --

Signed and Sealed this
Twelfth Day of February, 2013

Teresa Stanek Rea
*Acting Director of the United States Patent and Trademark Office*